US010502436B2

(12) United States Patent
Koo et al.

(10) Patent No.: US 10,502,436 B2
(45) Date of Patent: Dec. 10, 2019

(54) OUTDOOR DEVICE FOR AN AIR CONDITIONER

(71) Applicant: LG ELECTRONICS INC., Seoul (KR)

(72) Inventors: Kyomin Koo, Seoul (KR); Hoki Lee, Seoul (KR); Sangyoung Kwon, Seoul (KR); Hyunjun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 896 days.

(21) Appl. No.: 14/934,957

(22) Filed: Nov. 6, 2015

(65) Prior Publication Data

US 2016/0187006 A1 Jun. 30, 2016

(30) Foreign Application Priority Data

Dec. 29, 2014 (KR) ..... 10-2014-0192213
Jan. 5, 2015 (KR) ..... 10-2015-0000591

(51) Int. Cl.
*F24F 1/56* (2011.01)
*F24F 1/22* (2011.01)
*F24F 1/26* (2011.01)

(52) U.S. Cl.
CPC ..... *F24F 1/56* (2013.01); *F24F 1/22* (2013.01); *F24F 1/26* (2013.01)

(58) Field of Classification Search
CPC ..... F24F 1/22; F24F 1/24; F24F 1/56; F24F 2013/207
See application file for complete search history.

(56) References Cited

U.S. PATENT DOCUMENTS 8,378,213 B1 * 2/2013 Gerardo ..... H02G 3/126 174/481
2005/0122017 A1 * 6/2005 Son ..... F25D 25/00 312/404
2009/0137197 A1 * 5/2009 Jang ..... F24F 1/22 454/184

FOREIGN PATENT DOCUMENTS

CN 201740162 2/2011
CN 103547867 1/2014
(Continued)

OTHER PUBLICATIONS

Korean Office Action dated Mar. 30, 2016.
(Continued)

*Primary Examiner* — Jianying C Atkisson
*Assistant Examiner* — Jose O Class-Quinones
(74) *Attorney, Agent, or Firm* — Ked & Associates LLP

(57) ABSTRACT

An outdoor device for an air conditioner is provided. The outdoor device may include a case including a front panel that defines a front surface thereof and including a service panel, side panels that defines both sides thereof, and a rear panel that defines a rear surface thereof, an outdoor heat exchanger provided inside of the case, the outdoor heat exchanger having four heat exchange surfaces at positions corresponding to suction holes respectively defined in the front panel, the side panels, and the rear panel, a control box provided at a rear side of the service panel, the control box including an electronic case to accommodate an electronic component, and a mover provided at one side of the case to guide movement of the control box. The control box may be movable in a direction in which a space defined between the electronic case and the heat exchanger is increased in volume by the mover.

19 Claims, 13 Drawing Sheets

(56) References Cited

FOREIGN PATENT DOCUMENTS

| | | |
|---|---|---|
| JP | H09-236281 | 9/1997 |
| JP | 10-54589 | 2/1998 |
| JP | 2008-002741 | 1/2008 |
| JP | 2009-079870 | 4/2009 |
| JP | 2009-127991 | 6/2009 |
| JP | 2012-242026 | 12/2012 |
| JP | 2013-029262 | 2/2013 |
| KR | 10-2009-0053491 | 5/2009 |
| WO | WO 02/053976 | 7/2002 |

OTHER PUBLICATIONS

European Search Report dated Jun. 3, 2016 issued in Application No. 15191035.3.
Chinese Office Action dated Aug. 2, 2018 with English Translation.

* cited by examiner

OUTDOOR DEVICE FOR AN AIR CONDITIONER

CROSS-REFERENCE TO RELATED APPLICATION(S)

The present application claims priority under 35 U.S.C. 119 and 35 U.S.C. 365 to Korean Patent Application No. 10-2014-0192213, filed in Korea on Dec. 29, 2014 and No. 10-2015-0000591, filed in Korea on Jan. 5, 2015, which are hereby incorporated by reference in their entirety.

BACKGROUND

1. Field

An outdoor device for an air conditioner is disclosed herein.

2. Background

In general, air conditioners are apparatuses that adjust an indoor temperature to promote a pleasant indoor environment. Such an air conditioner may include an indoor unit or device installed in an indoor space to adjust a temperature of indoor air and an outdoor unit or device installed in an outdoor space to supply a refrigerant to be heat-exchanged with external air into the indoor device.

The air conditioner may operate in a cooling mode or a heating mode by controlling a refrigerant flowing along a tube provided therein. The refrigerant flowing along the above-described tube may be controlled by an electronic component of a control box provided in the outdoor device.

However, as the control box according to the related art is fixed at a preset or predetermined position is a case of the outdoor device, when the control box is installed on the outdoor device, the control box may interfere with the tube. Also, when a worker repairs the tube disposed at a rear side of the control box, the control box has to be separated from the outdoor device.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a connection structure of a control box according to an embodiment will be described with reference to the accompanying drawings.

Figure 1:
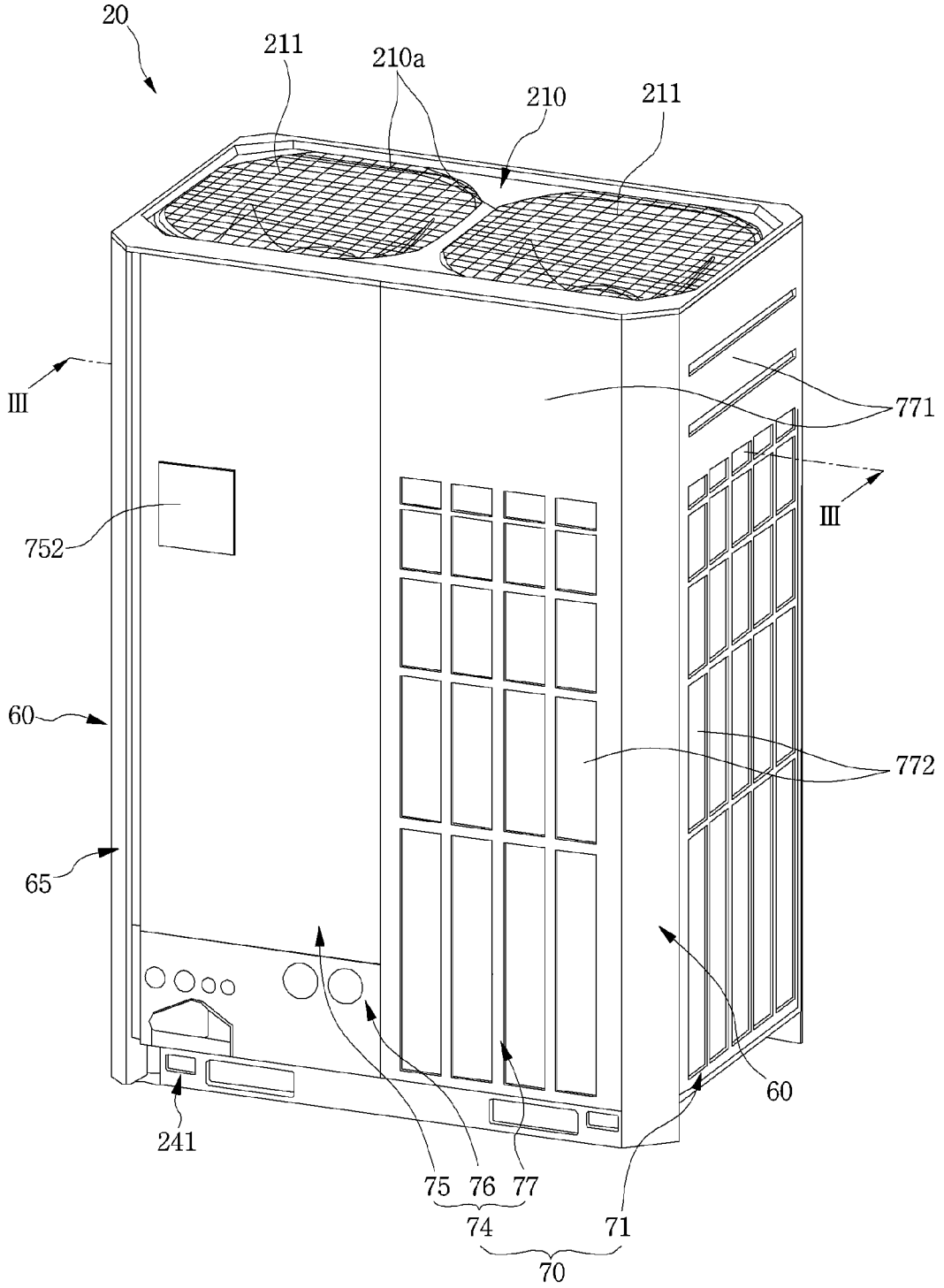
FIG. 1 is a perspective view of an outdoor device for an air conditioner according to an embodiment.
Figure 2:
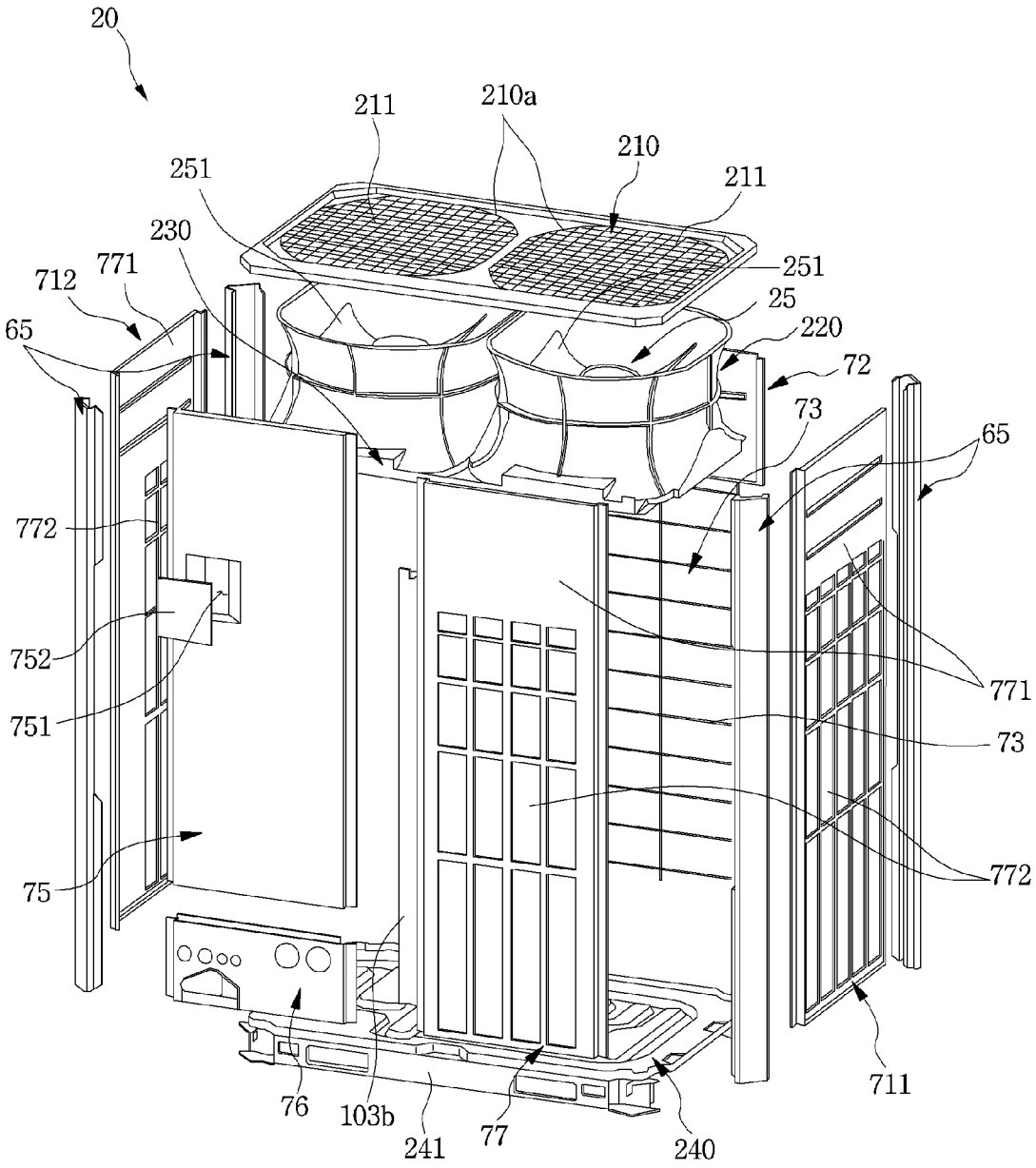
FIG. 2 is an exploded, perspective view illustrating an outer appearance of the outdoor device of FIG. 1.
Figure 3:
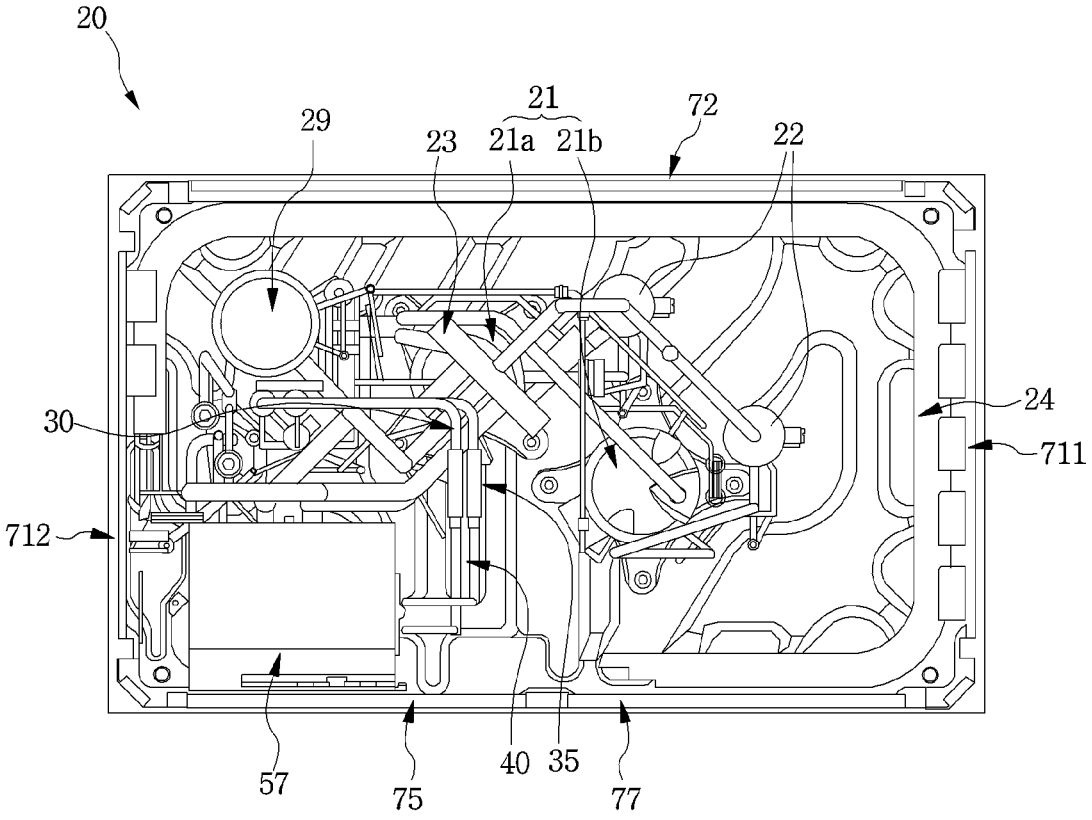
FIG. 3 is a cross-sectional view taken along line III-III of FIG. 1.

FIG. 1 is a perspective view of an outdoor device for an air conditioner according to an embodiment. FIG. 2 is an exploded, perspective view illustrating an outer appearance of the outdoor device of FIG. 1. FIG. 3 is a cross-sectional view taken along line III-III of FIG. 1.

Referring to FIGS. 1 to 3, the air conditioner according to an embodiment may include an indoor unit or device (not shown) and an outdoor unit or device 20. The indoor device (not shown) may include an indoor device heat exchanger (not shown), in which a refrigerant and indoor air may be heat-exchanged with each other. The outdoor device 20 may be connected to the indoor device (not shown) by a refrigerant tube 30 to supply a refrigerant which is heat-exchanged with external air into the indoor device (not shown).

The outdoor device 20 may include a case 60 that defines an outer appearance thereof. The case 60 may have a top surface defined by a cover plate 210.

A pair of discharge holes 210*a* may be defined in the cover plate 210. A discharge grill 211 may be mounted on the discharge holes 210*a* to prevent external foreign substances from being introduced into the discharge hole 210*a*.

One or more shroud 220 may be mounted on an inner upper portion of the outdoor device 20, and one or more fan motor assembly 25 may be provided inside of the one or more shroud 220, respectively. The shroud 220 may guide discharge air. Thus, the shroud 220 may be vertically opened and have a side surface, which may be rounded in a shape, a central portion of which may be recessed in an inward direction. Also, the shroud 220 may have an opening which may be gradually expanded in an upward direction from the central portion. The opened top surface of the shroud 220 may have a same shape as the discharge hole 210*a* to effectively guide the discharge air to the discharge hole 210*a*.

Each fan motor assembly 250 may include a motor (not shown), and a blower fan 251. Each fan motor assembly 25 may be provided in the one or more shroud 220, respectively, to forcibly discharge air.

Each fan motor assembly 25 may be seated on a mounting member 230. The shroud 220 may be mounted on the mounting member 230 and be fixed to an inner upper portion of the outdoor device 20. Each mounting member 230 may be coupled to one side of an outer panel 70 that defines a side surface of the outdoor device 20.

The case 60 may have a bottom surface, which may be defined by a base pan 240. The base pan 240 may be supported in a state in which the base pan 240 is spaced apart from a bottom surface by a base frame 241. A compressor 21 and an outdoor heat exchanger 24 that form a refrigerating cycle may be provided on a top surface of the base fan 240.

The compressor 21 may be provided on or at a central portion of the base frame 241. The compressor 21 may compress a refrigerant having a gaseous state to a high-temperature, high-pressure state. The compressor 21 may include a constant speed compressor that rotates at a constant speed to compress a refrigerant to a predetermined capacity and an inverter compressor, which is variable in rotation speed according to a load to adjust a compressing capacity. The constant speed and the inverter compressor, may be referred to as a first compressor 21*a* and a second compressor 21*b*, respectively.

An oil separator 22 that separates oil contained in the refrigerant discharged from the compressor 21 may be provided on the refrigerant tube 30 connected to an outlet of the compressor 21. A four-way valve 23 selectively supplies the refrigerant passing through the oil separator 22 into an indoor heat exchanger or the outdoor heat exchanger 24 may be provided.

The four-way valve 23 may be connected to the indoor heat exchanger, the outdoor heat exchanger 24, the compressor 21, and an accumulator 29 to switch a passage so that the refrigerant discharged from the compressor 21 may be selectively supplied into the indoor heat exchanger and the outdoor heat exchanger 24 according to a cooling operation or a heating operation. The accumulator 29 may be provided on or at one side of the base pan 240 and connected to the indoor heat exchanger and the four-way valve 23. The accumulator 29 may separate an introduced liquid refrigerant and the gaseous refrigerant from each other to store the liquid refrigerant and supply the gaseous refrigerant into the compressor 21.

External air and the refrigerant may be heat-exchanged with each other in the outdoor heat exchanger 24. The outdoor air may be heat-exchanged with the refrigerant while forcibly passing through the outdoor heat exchanger 24 via the blower fan 251 of the outdoor heat exchanger 24.

A control box 57 that accommodates an electronic component that controls components, such as the compressor 21, the oil separator 22, and the four-way valve 23 may be provided in the case 60.

The outdoor heat exchanger 24 may be provided along an inner surface of the case 60. The outdoor heat exchanger 24 may be provided in a state in which a portion of the outdoor heat exchanger 24 is removed from a circumference of the inner surface of the case 60 so that a worker may easily access components, such as the compressor 21, the oil separator 22, and the four-way valve 23.

That is, the outdoor heat exchanger 24 may be provided along the circumference of the inner surface of the case 60 on an area remaining except for the area on which the control box 57 is installed. For example, the outdoor heat exchanger 24 may be provided to be bent from a first side to a second side of the control box 57 along the inner surface of the case 60.

For example, the control box 57 may be provided at an inner front left side of the case 60, as shown in the drawings. The outdoor heat exchanger 24 may be provided to be bent from a position which is spaced apart from a left rear portion of the control box 57 to a position which is spaced apart from a right front portion of the control box 57 along the inner surface of the case 60. According to the above-described structure, the outdoor heat exchanger 24 may have four heat exchange surfaces.

A direction of the outdoor device 20 may be defined as follows. A surface of the outdoor device 20, on which a front panel 74 may be provided, may be referred to as a "front surface", surfaces provided on both sides of the front surface of the outdoor device 20 and on which side panels 71 may be respectively provided may be referred to as "both side surfaces" or "left and right surfaces". A surface which is opposite to the front surface of the outdoor device 20 and on which the rear panel 72 is provided may be referred to as "a rear surface".

An installation position of control box 57 may be changed by moving units or movers 80 and 90, which will be described hereinafter. Thus, when a service situation for the outdoor device 20 occurs, a worker may easily access components, such as the compressor 21, the oil separator, and the four-way valve 23.

Further, the compressor 21, the oil separator 2, the four-way valve 23, and the outdoor heat exchanger 24, which form a freezing cycle within the outdoor device 20, may be connected by the refrigerant tube 30. Thus, the high-temperature, high-pressure refrigerant discharged from the compressor 21 may circulate through a refrigerant circuit along the refrigerant tube 30. Also, the air conditioner may operate in a cooling mode or a heating mode according to a user's manipulation. A flow direction of the refrigerant may be switched by the four-way valve 23.

Four edges of the case 60 may be defined by side supports 65. Each side support 65 may be bent.

Each outer panel 70 may be disposed between side supports 65 to define an outer appearance of each side surface of the outdoor device 20. The outer panel 70 may include side panels 70 that defines first and second or left and right side surfaces of the outdoor device 20, a front panel 74 that defines a front surface of the outdoor device 20, and a rear panel 72 that defines a rear surface of the outdoor device 20. That is, the front panel 74 may be provided between first and second side supports of the four side supports 65, and the side panels 71 may be provided between the first and fourth side supports 65 and between the second and third side supports 65, respectively. The rear panel 72 may be provided between the third and fourth side supports 65.

The side panels 71 may be provided at positions corresponding to the first and second or left and right side surfaces of the four bent surfaces of the outdoor heat exchanger 24 and maybe provided in a plate shape that connects the adjacent side support, the base pan 240, and the cover plate 210 to each other. A plurality of suction holes 722 may be defined in a lower portion of the side panel 71 except for an upper cover portion 771, at which the shroud 220 and the fan motor assembly 25 may be disposed. The plurality of suction holes 772 may be uniformly defined over an entire area at which the outdoor heat exchanger 24 is provided to allow air suctioned from a lateral direction to pass through the outdoor heat exchanger 24.

The plurality of suction holes 772 may be defined in a portion of a first or right side panel 711 of the side panels 71 of the outdoor device 20 except for the upper cover portion 771. The plurality of suction holes 772 may also be defined in an area except for the upper cover portion 771 and a portion of the front portion in a second or left side panel 712 of the side panels 71 of the outdoor 20.

That is, the plurality of suction holes 722 may be defined up to an area of the side panel 712 to which the outdoor heat exchanger 24 extends, and the front portion of the side panel 712 may cover a portion at which the components forming the freezing cycle are concentrated. In summary, the plurality of suction holes 772 defined in the side panel 71 may be provided in or at a position at which the outdoor heat exchanger 24 is provided.

The rear panel 72 may be provided on or at a portion of the rear surface of the outdoor device 20, which corresponds to a portion on which the shroud 220 and the fan motor assembly 25 are provided. A suction grill 73 may extend from a lower end of the rear panel 72 to the base pan 240. Thus, external air may be introduced through the suction grill 73, and the suction grill 73 may protect the outdoor heat exchanger 24 against an external impact or foreign substances. The rear panel 72 may be provided on or at a rear surface of the four bent surfaces of the outdoor heat exchanger 24.

A plurality of front panels 74 may be provided on the front surface of the outdoor device 20. The front panel 74 may include a service panel 75, a tube panel 76, and a suction panel 77. The front surface of the outdoor device 20 may be divided into first and second or left and right sides with respect to an extending area of the outdoor heat exchanger 24. That is, the service panel 75 and the tube panel 76 may be provided on the left or first side of the outdoor device 20, and the suction panel 77 may be provided on the right or second side of the outdoor device 20.

That is, the service panel 75 may define a portion of the front surface of the outdoor device 20 as a "service surface". The service panel 75 may be provided at a front side of the control box 57 to extend from a left or first side of the outdoor device 20 to a position corresponding to an extending end of the outdoor heat exchanger 24. The service panel 75 may be independently detachable in a state in which all of the front panels are mounted. Thus, as the service panel 75 is detachable, a worker may easily access inner components of the outdoor device 20.

When the service panel 75 is opened, all of the control box 57 may be exposed to the front side. Thus, a worker may easily access the compressor 21, the accumulator 29, the oil separator 22, and the four-way valve 23, for example.

A service door 752 may be provided on the service panel 75. The service door 752 may be mounted to independently open and close a service window 751 defined in the service panel 75. The service window 751 may be opened at a position corresponding to a position on or at which components to be frequently confirmed or manipulated of main components of the control box 57 may be provided. Thus, if a user or worker intends to check or determine whether the air conditioner is normal, the service door 752 may be opened to allow the user or worker to access the main components within the control box 57 without separating the whole service panel 75, thereby performing the work.

The tube panel 76 may be provided for penetration and fixing of the refrigerant tube 30 to connect the outdoor device 20 to the indoor device. The tube panel 76 may be provided between a lower end of the service panel 75 and the base pan 240.

The suction panel 77 may define an outer appearance of a remaining front surface of the outdoor device 20. The suction panel 77 may be provided on a front surface of the four bent surfaces of the outdoor heat exchanger 24. The suction panel 77 may extend from the cover plate 210 to the base pan 240 in a vertical direction and extend from the side support 65 to the service panel 75 and the tube panel 76 in a horizontal direction.

The suction panel 77 may extend up to an end of the outdoor heat exchanger 24. The suction panel 77 may be configured so that a second plate 103*b*, which is described hereinafter, to which an end of the outdoor heat exchanger 24 may be coupled, may be coupled to an end of the suction panel 77. Thus, the outdoor heat exchanger 24 may be maintained in a stably fixed state by the suction panel 77.

A cover portion 771 may be provided on an upper portion of the suction panel 77 to cover the shroud 220 and the fan motor assembly 25. A plurality of suction holes 772 may be defined in a lower portion of the cover portion 771 to allow external air to flow toward the outdoor heat exchanger 24.

The plurality of suction hole 772 may have vertical lengths that gradually decrease in the upward direction from a lower side and areas that gradually decrease in the upward direction from the lower side. Thus, the plurality of suction holes 722 may be uniformly distributed in an entire surface provided adjacent to the outdoor heat exchanger 24.

Figure 4:
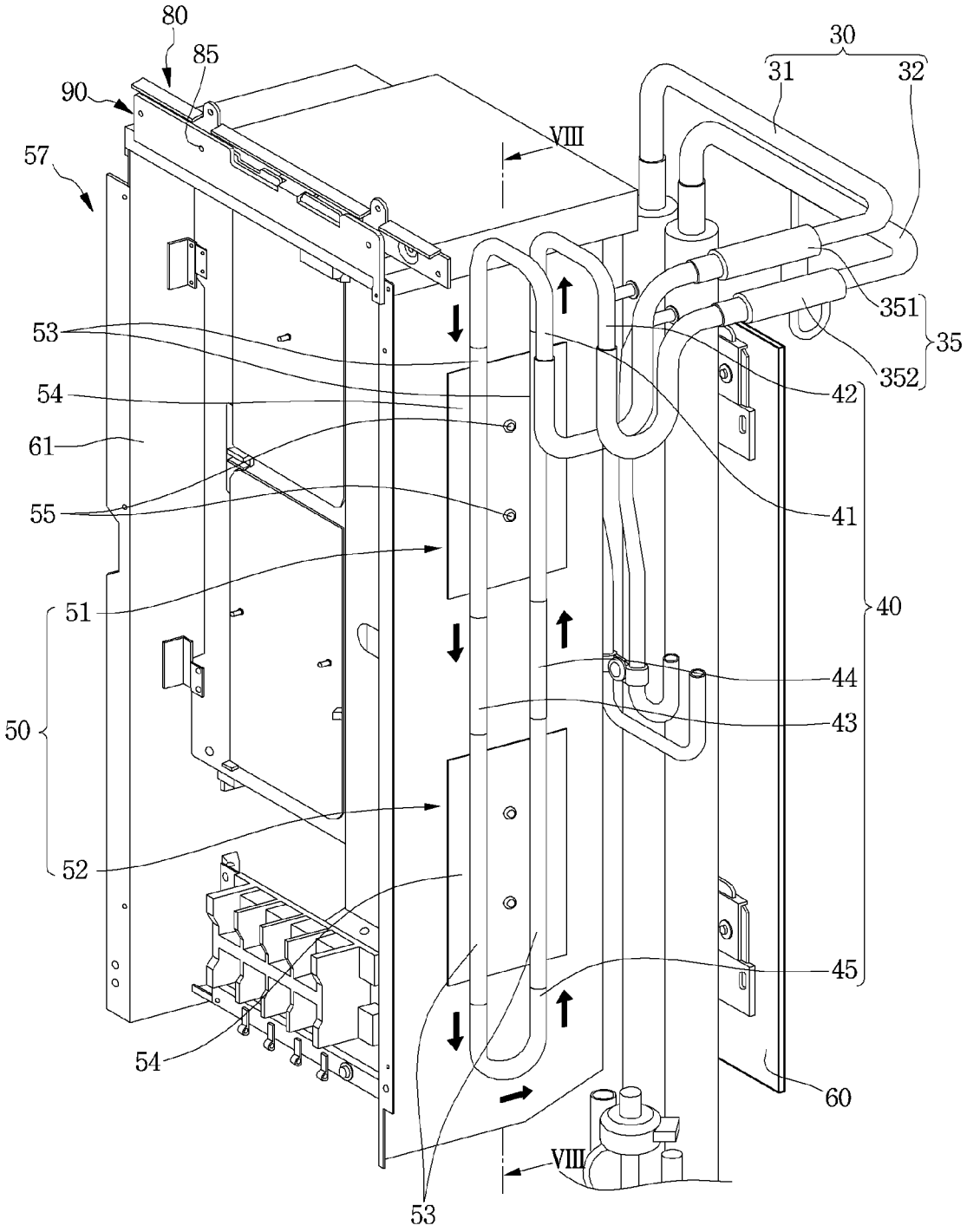
FIG. 4 is a perspective view of a control box and a refrigerant tube connected to the control box of the outdoor device of FIG. 1.

FIG. 4 is a perspective view of a control box and a refrigerant tube connected to the control box of the outdoor device of FIG. 1. Referring to FIG. 4, the control box 57 may include an electronic case 61 that defines a predetermined inner space. The control box 57 or the electronic case 61 may have a rectangular parallelepiped shape having a vertical height greater than a horizontal width. Also, the service panel 57 may have a rectangular plate shape corresponding to the shape of the control box 57 or the electronic case 61.

An electronic board and a plurality of control components provided on the electronic board may be provided within the electronic case 61. The plurality of control components may include a heat generation component (not shown) that generates heat having a high temperature.

For example, the heat generation component (not shown) may include a power module, for example, an intelligent power module (IPM)). The IPM may be understood as a drive circuit of a power device, such as a power MOSFET or IGBT and a protection circuit having a self-protection function. The power module may be referred to as a "power device". The electronic board may be a portion of the IPM. When the power module is driven, a switching device or switch provided in the power module may be turned on or off to generate heat having a temperature of about 70° C. to about 80° C.

Figure 8:
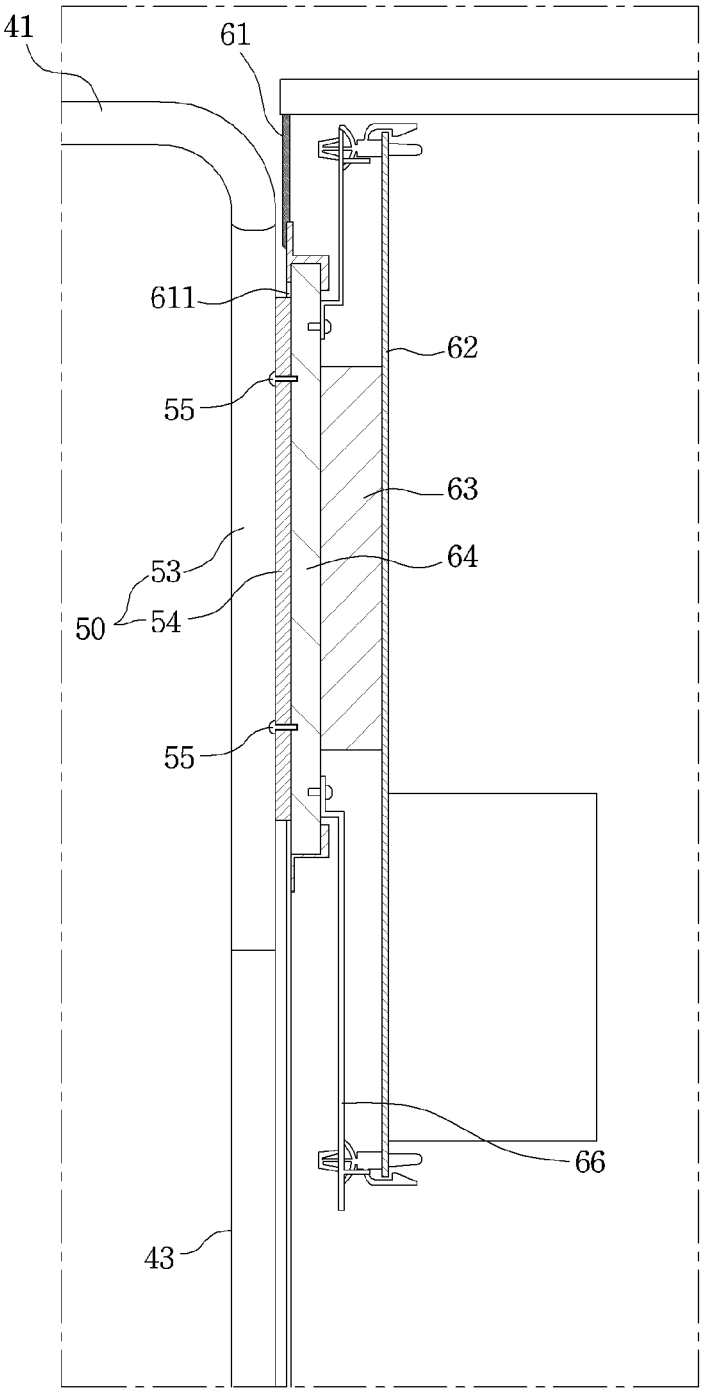
FIG. 8 is a cross-sectional view taken along line VIII-VIII' of FIG. 4.

The heat generation component (not shown) may be cooled by a cooling member 50. The cooling member 50 may be fixed to the heat generation component (not shown) by a cooling member coupling unit or device 55. The cooling member 50 may be provided on one side surface of the electronic case 61, and a mounting hole 611 (see FIG. 8) may be provided on one side surface of the electronic case 61, in which the cooling member 50 may be provided.

The mounting hole 611 may be provided within the cooling member 50 and have a size corresponding to a size of the cooling member 50. Also, if a plurality of the cooling member 50 is vertically provided, a plurality of the mounting hole 611 may also be provided at positions corresponding to the cooling members 50.

A cooling tube 40, which may be a portion of the refrigerant tube 30, may be connected to the cooling member 50 to transfer the refrigerant into the cooling member 50. The cooling tube 40 may be a tube that connects the outdoor heat exchanger 24 to a supercooler (not shown).

The refrigerant passing through the cooling member 50 may absorb heat transferred from the heat generation component (not shown) to the cooling member 50. The refrigerant tube 30 may be referred to as a "first tube", and the cooling tube 40 may be referred to as a "second tube".

The refrigerant tube 30 and cooling tube 40, which may be fixed to the case 60, may be connected to each other by a deformable tube 35. The deformable tube 35 may be formed of a material which is deformable by an external force.

As the deformable tube 35 is formed of a soft material which is deformable, a worker may move the control box 57 into a region in which the outdoor heat exchanger 24 is not provided through the movers 80 and 90 without separating the refrigerant tube 30 from the cooling tube 40. The deformable tube 35 may absorb a fluid impact generated in the refrigerant tube 30 and the cooling tube 40 to prevent the refrigerant tube 30 and the cooling tube 40 from being damaged.

The refrigerant tube 30 may include a supply tube 31 and a discharge tube 32. The supply tube 31 may provide a passage through which the liquid refrigerant may be supplied into the control box 57, and the discharge tube 32 may provide a passage through which the refrigerant heat-exchanged with the control box 57 may be discharged.

The cooling tube 40 may include a first cooling tube 41, a second cooling tube 42, a first connection tube 43, a second connection tube 44, and a switching tube 45. The first cooling tube 41 may communicate with the supply tube 31 via the deformable tube 35. The second cooling tube 42 may communicate with the discharge tube 32 via the deformable tube 35.

The deformable tube 35 may include a first deformable tube 351 that connects the supply tube 31 to the first cooling tube 41 and a second deformable tube 352 that connects the discharge tube 32 to the second cooling tube 42.

The cooling member 50 may include a first cooling member 51 and a second cooling member 52, which may be vertically provided. That is, the first and cooling member 51 and the second cooling member 52 may be vertically oriented, and the mounting hole(s) 611 may be provided to correspond to the cooling members 51 and 52. The cooling member 50 may further include a pair of tubes 53, which may be respectively connected to the cooling tubes 40 to provide a passage through which the refrigerant may flow, and a heat transfer portion 54 having a plate shape and that contact the pair of tubes 53.

The first cooling member 51 may be provided above the second cooling member 52. An upper end of the tube 53 of the first cooling member 51 may be connected to each of the first cooling tube 41 to guide the refrigerant in one direction and the second cooling tube 42 to guide the refrigerant in the other direction.

A lower end of the tube 53 of the first cooling member 51 may be connected to an upper end of each of the first and second connection tubes 43 and 44, and a lower end of each of the first and second connection tubes 43 and 44 may be connected to an upper end of the tube 53 of the second cooling member 52. A lower end of the tube 53 of the second cooling member 52 may be connected to each of both open ends of the switching tube 45. The switching tube 45 may be rounded or bent to switch a flow direction of the refrigerant. That is, the switching tube 45 may switch a flow direction of the refrigerant so that the refrigerant introduced into the control box 57 through the supply tube 31 and the first cooling tube 41 may be heat-exchanged and then may be discharged into the second cooling tube 42 and the discharge tube 32.

The first cooling member 51 and the second cooling member 52 may communicate with each other via the cooling tube 40 to provide a flow path of the refrigerant. Thus, the refrigerant introduced into the cooling tube 40 may continuously pass through the cooling tube 40 and the pair of tubes 53 to absorb heat generated in the heat generation component of the control box 57.

Figure 5:
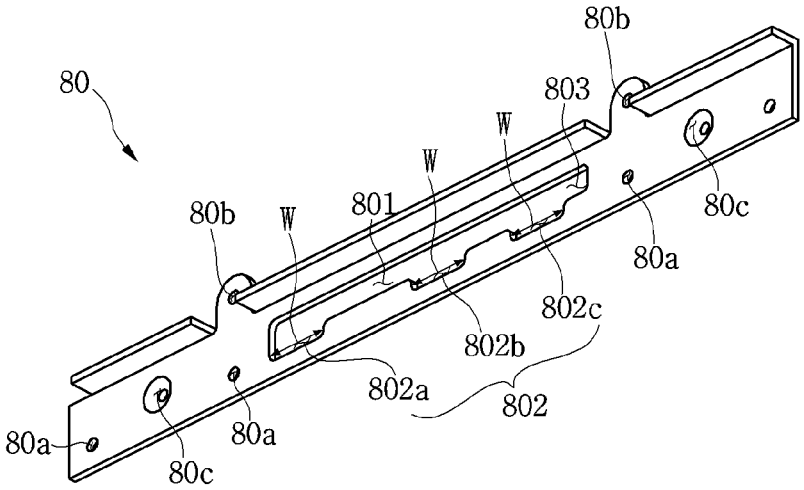
FIG. 5 is a perspective view of a first bracket fixed to a portion of a case of FIG. 4.
Figure 6:
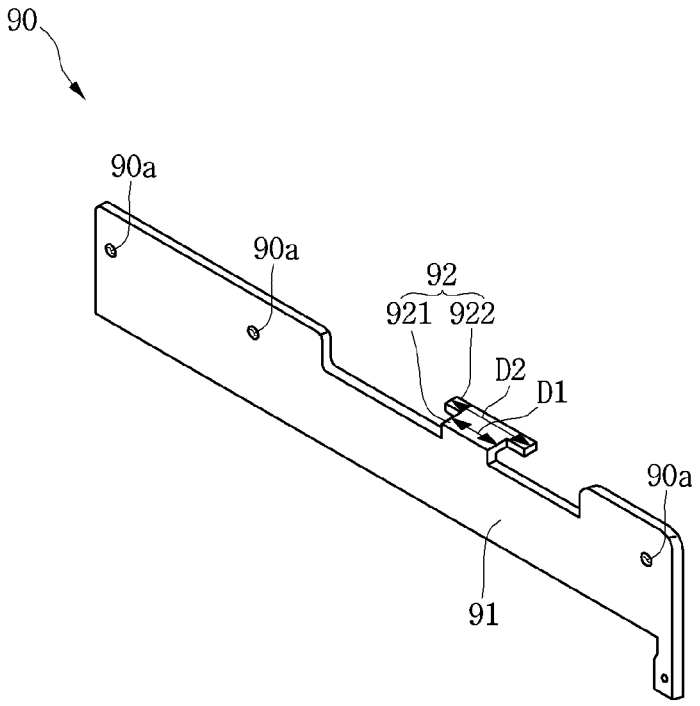
FIG. 6 is a perspective view of a second bracket fixed to the control box of FIG. 4.
Figure 7A:
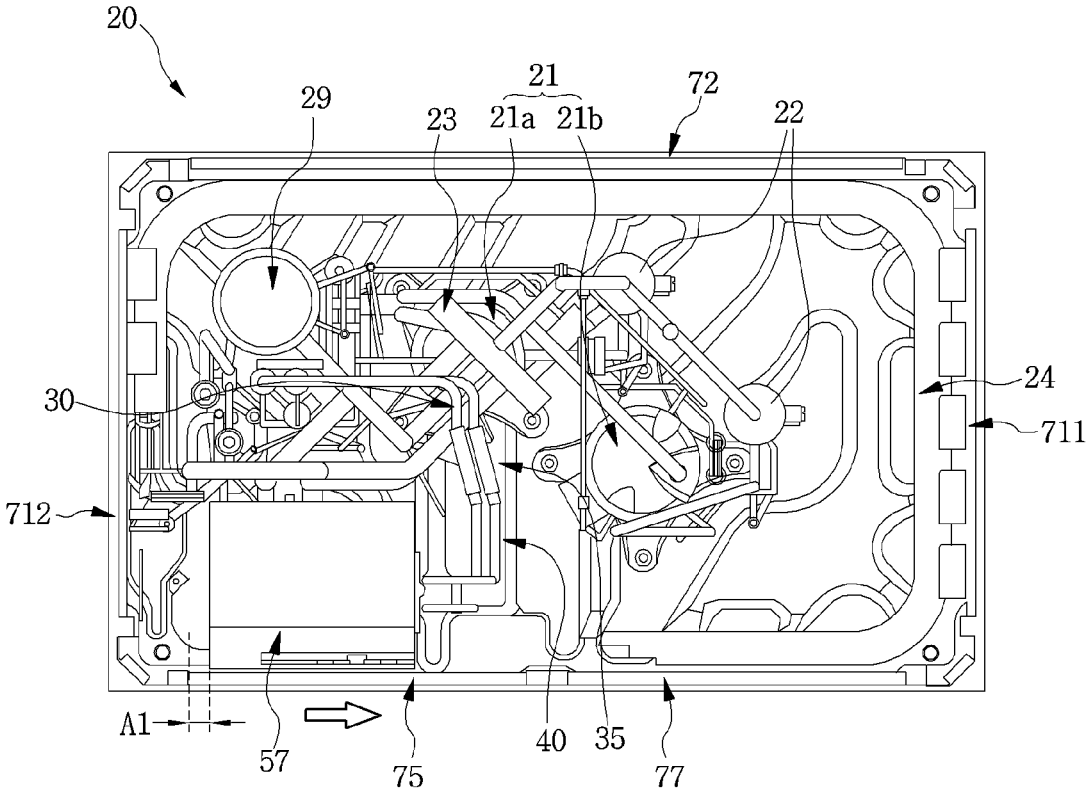
FIGS. 7A to 7C are views for explaining a position at which the control box is provided within the case according to a position at which the second bracket of FIG. 6 is seated on the first bracket of FIG. 5.
Figure 7B:
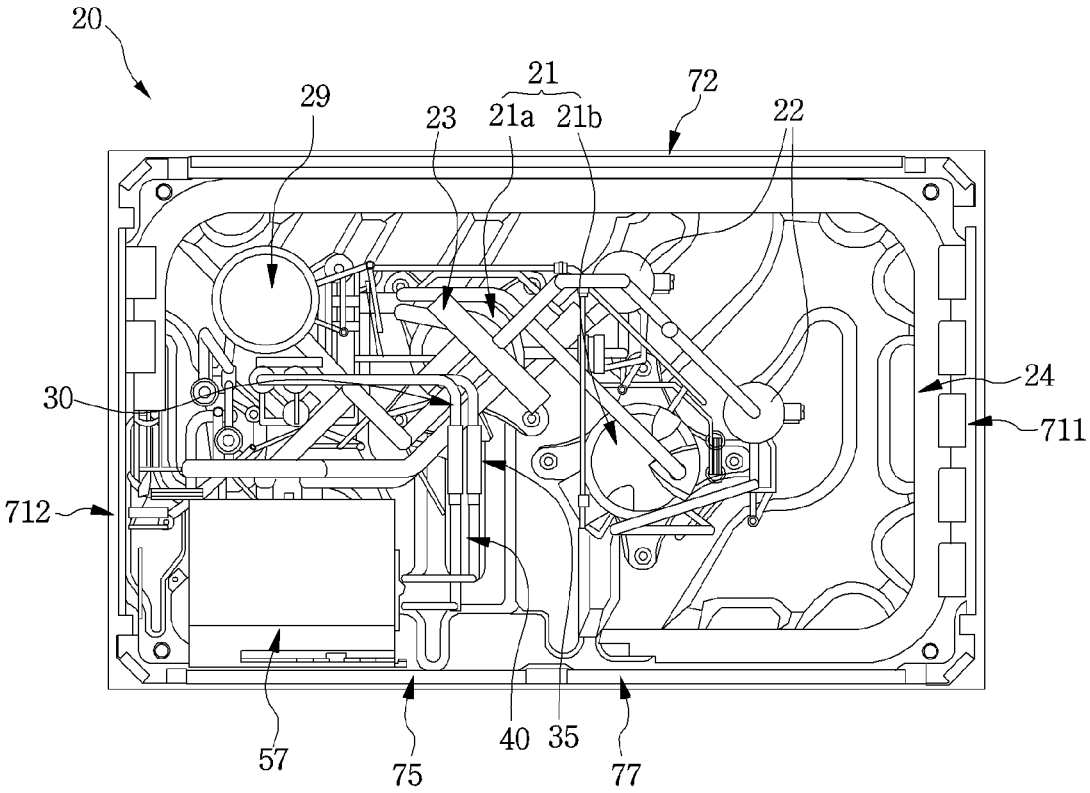
Figure 7C:
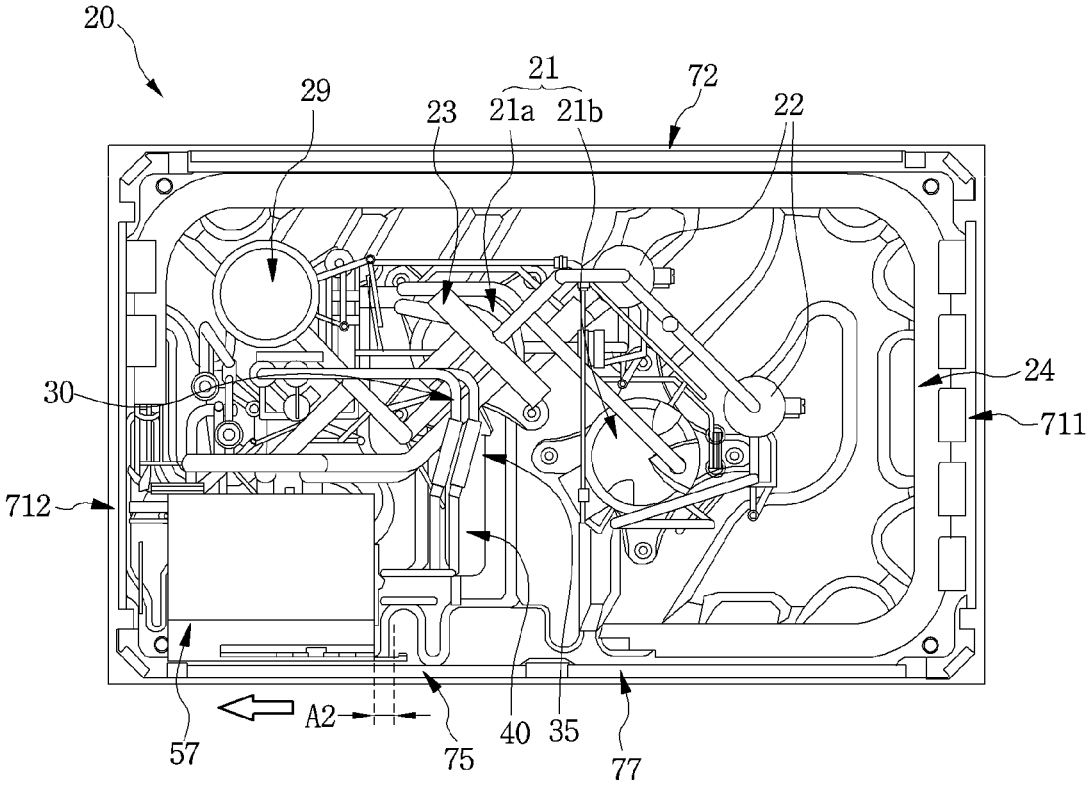

FIG. 5 is a perspective view of a first bracket fixed to a portion of a case of FIG. 4. FIG. 6 is a perspective view of a second bracket fixed to the control box of FIG. 4. FIGS. 7A to 7C are views for explaining a position at which the control box is provided within the case according to a position at which the second bracket of FIG. 6 is seated on the first bracket of FIG. 5.

Referring to FIGS. 5 to 7C, the structure for connecting the control box may include the case 60, the control box 57, and the movers 80 and 90. The control box 57 may be provided within the case 60 and then adjusted in position within a predetermined area, that is, a region in which the outdoor heat exchanger 24 is not provided. The control box 57 may be movable to a left or right or first or second side in the region in which the outdoor heat exchanger 24 is not provided.

The control box 57 may be moved by the movers 80 and 90. The movers 80 and 90 may include a first bracket 80 and a second bracket 90.

The first bracket 80 may be fixed to the case 60, and the second bracket 90 may be fixed to the control box 57. The second bracket 90 may be selectively seated on or at a plurality of positions of or on the first bracket 80.

The first bracket 80 may be coupled to the left or first side panel 712 to extend in a right or first direction. An upper portion of the first bracket 80 may be supported by the mounting member 230. That is, the first bracket 80 may be fixed to a lower portion of the mounting member 230, which may be provided above the control box 57.

The second bracket 90 may be fixed to an upper portion of the front surface of the control box 57. The second bracket 90 may be supported by the first bracket 80. While the control box 57 moves, the first and second brackets 80 and 90 may change in relative position. That is, when the second bracket 90 selectively seated on the plurality of positions of the first bracket 80 changes in position, the control box 57 connected to the second bracket 90 may change in position within the case 57.

First and second coupling holes 80*b* and 80*c* may be defined in the first bracket 80. The first bracket 80 may be coupled to the case 60, that is, the mounding member 230 by a plurality of coupling members, such as bolts, that passes through each of the first and second coupling holes 80*b* and 80*c*, respectively.

A first opening 801 may be defined in the first bracket 80, and a plurality of seat grooves 802 may be defined below the first opening 801. The plurality of seat grooves 802 may include a first seat groove 802*a*, a second seat groove 802*b*, and a third seat groove 803*c*. The first, second, and third seat grooves 802*a*, 802*b*, and 802*c* may be spaced apart from each other.

The first, second, and third seat grooves 802*a*, 802*b*, and 802*c* may be spaced apart from each other and successively defined from a left or first side to a right or second side in the drawings. That is, the first seat groove 802*a* may be defined adjacent to one side of the case 60, that is, the left or first side panel of the outdoor device 20 in the drawings, and the third seat groove 802*c* may be provided to be spaced apart from the first seat groove 802*a* in the right or second direction within the case 60. The second seat groove 802*b* may be provided between the first seat groove 802*a* and the third seat groove 802*c*.

The second bracket 90 may include a fixed plate 91 and a seated plate 92. The fixed plate 91 may be fixed to the control box 57. The seated plate 92 may extend from the fixed plate 91 and then may be selectively seated on the plurality of seat grooves 802.

The seated plate 92 may be bent backward from the fixed plate 91. The seated plate 92 may include a first plate 921 seated on each of the seat grooves 802, and a second plate 922, which may be fixed to the first plate 921 to prevent the first plate 921 from being separated from the seat groove 802.

The first plate 921 may have a first length D1 in a left/right or first/second direction, and the second plate 922 may have a second length D2 in the left/right or first/second direction. The first length D1 may be equal to or less than a length W of the seat groove in a widthwise direction. The second length D2 may be greater than the length W of the seat groove in the widthwise direction. That is, the second plate 922 may have a size greater than a size of the seat groove 802.

An interference prevention groove 803 that prevents a portion of the second plate 922 from interfering with the first bracket 80 when the second bracket 90 is installed on the first bracket 80 may be defined in or at one side of the first opening 801. The interference prevention groove 803 may prevent a portion of the second plate 922 from interfering with the first bracket 80 when the second plate 922 is inserted into the third seat groove 802*c*.

The first bracket 80 and the second bracket 90 may be fixed to each other by a plurality of fixing screws 85, for example. For this, a plurality of first screw holes 80*a* may be defined in the first bracket 80, and a plurality of second screw holes 90*a* may be defined in the second bracket 90. The plurality of fixing screws 85 may be coupled to each of the plurality of first and second screw holes 80*a* and 90*a*. The plurality of fixing screw 85 may be coupled to each of the first and second screw holes 80*a* and 90*a* when the seated plate 92 is seated on the second seat groove 802*b* (see a following normal mode).

Hereinafter, a position of the control box 57 within the case 60 will be described.

The control box 57 may be movable in a space between an end of the front surface of the outdoor heat exchanger 24 and the electronic case 61 of the control box 57 in a left or right, or first or second direction. The control box 57 may be supported by the second bracket 90 in a state in which the control box 57 moves to the set position.

The space between the end of the outdoor heat exchanger 24 and the one surface of the electronic case 61 may be referred to as a "space". In other words, as the front surface of the outdoor heat exchanger 24 is provided at a position corresponding to the plurality of suction holes 772 of the suction panel 77, the space may be a space defined between the plurality of suction holes 772 of the suction panel 77 and the electronic case 81.

When the seated plate 92 of the second bracket 90 is seated on the third seat groove 802*c*, a position of the control box 57 may be referred to as an "installation mode" or "installation position". In the installation mode, as the control box 57 moves by a distance A1 toward a central portion within the case 60 when compared to when the seated plate 92 of the second bracket 90 is seated on the second seat groove 802*b*, a worker may easily access components, such as the compressor 21, which may be provided at a rear side of the control box 57 (see FIG. 7A). That is, when the control box 57 is positioned in the installation mode, the space may have a size less than the distance A1.

When the seated plate 92 of the second bracket 90 is seated on the second seat groove 802*b*, the position of the control box 57 may be referred to as a "normal mode" or "normal position". In the normal mode, the first and second brackets 80 and 90 may be fixed to each other by the plurality of fixing screws 85, for example.

That is, the plurality of fixing screws 85 may be coupled to each of the first and second screw holes 80*a* and 90*a* when the seated plate 92 is seated on the second seat groove 802*b*. The first and second brackets 80 and 90 may be fixed to each other by the plurality of fixing screws 85 (see FIG. 7B). When the control box 57 is positioned in the normal mode, the space may have a relatively large size when compared to the installation mode.

Next, when the seated plate 92 of the second bracket 90 is seated on the first seat groove 802*a*, the position of the control box 57 may be referred to as a "service mode" or "service position". In the service mode, as the control box 57 moves by a distance A2 toward one side of the case 60, that is, toward the left or first side panel 712 when compared to when the seated plate 92 of the second bracket 90 is seated on the second seat groove 802*b*, a worker may easily connect the cooling tube 40 connected to the control box 57 to the refrigerant tube 30 via the deformable tube 35 (see FIG. 7C). When the control box 57 is positioned in the service mode, the space may have a relatively large size when compared to the normal mode or the installation mode.

In summary, the space may have a largest size when the control box 57 is positioned in the service mode and have a size that gradually decreases in order of the normal mode and the installation mode. When the position of the control box 57 changes in each of the installation mode, the normal mode, and the service mode, the deformable tube 35 that connects the cooling tube 40 to the refrigerant tube 30 may be deformed in shape.

Figure 9:
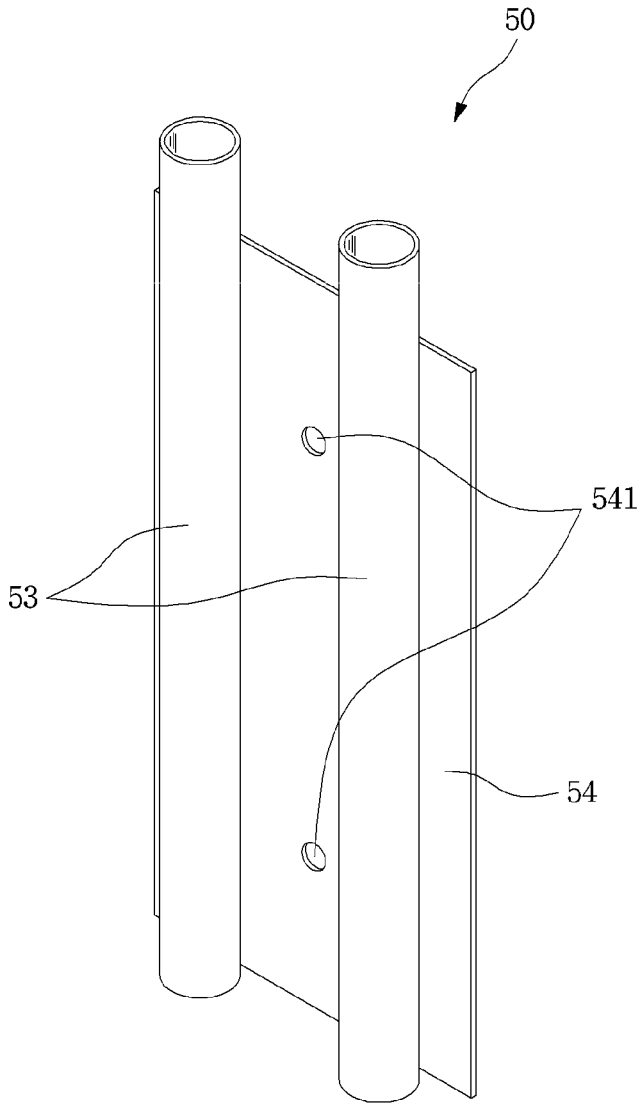
FIG. 9 is a perspective view of a cooling member of an electronic device according to an embodiment.

FIG. 9 is a perspective view of the cooling apparatus according to an embodiment. Referring to FIG. 9, the cooling member 50 may be formed of a meal material having superior thermal conductivity, such as aluminum or copper, for example. The cooling member 50 may include the pair of tubes 53, which may be respectively connected to the cooling tubes 40 to provide a passage through which the refrigerant may flow and the heat transfer position 54 having a plate shape and contacting the pair of tubes 53.

The pair of tubes 53 and the heat transfer portion 54 may be integrally molded. For example, the cooling member 50 may be molded using metal powder injection molding (MIM). That is, the pair of tubes 53, each of which may have a tube shape with both ends opened so that the refrigerant may flow therethrough and the heat transfer portion 54 that contacts the pair of tubes 53 in a longitudinal direction may be integrally molded using injection molding, for example.

Thus, the pair of tubes 53 and the heat transfer portion 54 may be formed of a same material. The refrigerant passing through the pair of tubes 53 may be heat-exchanged with the heat generation component 63 through the heat transfer portion 54.

Each of the pair of tubes 53 may have a tube shape with a circular section and extend further in a vertical direction than the heat transfer portion 54. Thus, both opened ends of each of the pair of tubes 53 may further protrude than the vertical ends of the heat transfer portion 54 so that the opened end may be easily connected to the cooling tubes 40.

The heat transfer portion 54 may have a plate shape. The heat transfer portion 54 may have a size and shape corresponding to a size and shape of the mounting hole 611 so that the heat transfer portion 54 may be accommodated in the mounting hole 611 and mounted therein via one or more coupling members and through-holes 541.

The heat transfer portion 54 may have a thin plate shape. Also, the heat transfer portion 54 may have a thickness thicker than a thickness of the electronic case 61. This is done to prevent the pair of tubes 53 or the cooling tube 40 from interfering with the electronic case 61 when the cooling member 50 is mounted.

The first and second cooling members 51 and 52 may communicate with each other via the cooling tube 40 to provide a flow path for the refrigerant. Thus, the refrigerant introduced into the cooling tube 40 may be heat-exchanged with the heat generation component 63 through the heat transfer portion 54 while continuously passing through the cooling tube 40. Then, the refrigerant may continuously cool the heat generation component 63 while flowing in one direction and then flowing in the other direction in the switching tube 45.

As described above, the refrigerant that performs cooling two times may flow toward the supercooler. Heat generated in the electronic device 60 may have a temperature of about 70° C. to about 80° C. or more. Also, as the refrigerant passing through the outdoor heat exchanger 24 and the indoor expansion valve (not shown) has a temperature of about 30° C., the refrigerant may effectively cool the electronic device 60.

The deformable tube 35 may include the first deformable tube 351 that connects the supply tube 31 to the first cooling tube 41, and the second deformable tube 352 that connects the first cooling tube 41 to the second cooling tube 42. The first deformable tube 351 and the second deformable tube 352 may be the same.

Figure 10:
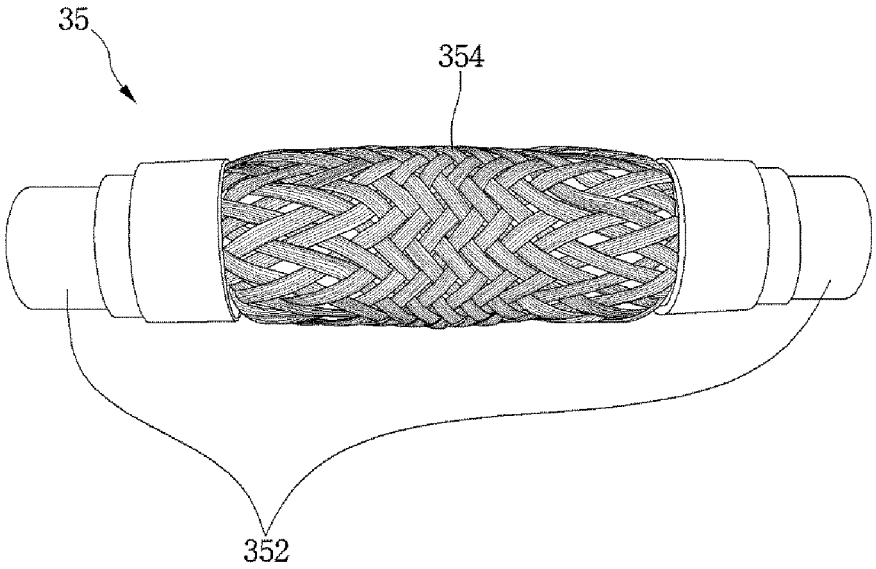
FIG. 10 is a perspective view of a deformable tube in a refrigerant tube structure according to an embodiment.
Figure 11:
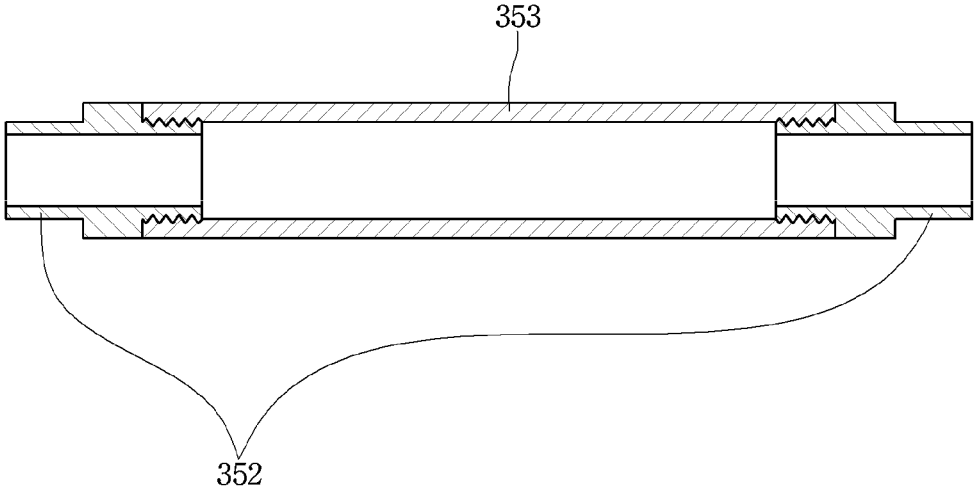
FIG. 11 is a cross-sectional view of a tube and a pair of connectors of the deformable tube of FIG. 10.

FIG. 10 is a perspective view of a deformable tube in a refrigerant tube structure according to an embodiment. FIG. 11 is a cross-sectional view of a tube and a pair of connectors of the deformable tube of FIG. 10.

Referring to FIGS. 10 and 11, the deformable tube 35 may include a tube 353 and a pair of connectors 352. The tube 353 may be formed of a material which is deformable by an external force. For example, the tube 353 may be a rubber tube formed of rubber or a corrugated tube.

The pair of connectors 352 may be fixed to both ends of the tube 353 and then connected to the first and second tubes 30 and 40, respectively. That is, the tube 353 may communicate with the refrigerant tube 30 and the cooling tube 40 by the pair of connectors 352.

The deformable tube 35 may further include a protection member 354. The protection member 354 may protect the tube 351 provided therein. The protection member 354 may be made by crossing or interweaving a plurality of wires with each other.

Referring again to FIG. 8, an electronic board 62, a heat generation component 63 coupled to the electronic board 62 to generate a predetermined heat, and a heat transfer plate 64 provided to contact the heat generation component 63, thereby transferring the heat of the heat generation component 63 to outside of the electronic case 61 may be provided in the electronic case 61.

The heat transfer plate 64 may be provided on an inner surface of the electronic case 61 and at a position corresponding to the mounting hole 611. That is, the heat transfer plate 64 may be provided at a position that contacts the heat transfer portion 54 of the cooling member 50 and may be maintained in a state in which the heat transfer plate 64 is coupled to the heat transfer portion 54 by the cooling member coupling device 55.

The heat generation component 63 and the heat transfer plate 64 may be provided between the inner surface of the electronic case 61 and the electronic board 62. That is, the electronic board 62 may be provided at a position which is spaced apart from the heat transfer plate 64. The heat generation component 63 may be provided between the electronic board 62 and the heat transfer plate 64.

According to an embodiment, when a worker separates the cooling member 50 from the electronic case 61, the deformable tube 35 may be deformable. Thus, only the cooling member coupling device 55 may be removed without separating the second tube 40 to separate the cooling member 50 from the electronic case 61. Similarly, when the electronic case 61 is separated from the case 201, the electronic case 61 may be separated from the case 201 without separating the whole cooling tube 40.

Also, according to an embodiment, although fluid impact of the refrigerant may be applied to one of the refrigerant tube 30 or the cooling tube 40, the deformable tube 35 may absorb the fluid impact to prevent the fluid impact of the refrigerant from being applied to the other one of the refrigerant tube 30 and the cooling tube 40 or the electronic device 60.

According to embodiments disclosed herein, as the outdoor heat exchanger is provided around the inner surface of the case in a state in which a portion of the outdoor heat exchanger is removed, a worker's accessibility with respect to components, such as the compressor, the oil separator, and the four-way valve, which may be provided in the indoor device, may be improved. Also, the control box may be movable in a region in which the outdoor heat exchanger is not provided. Thus, when a service situation occurs, a worker may easily access components, such as the compressor.

Further, as the deformable tube is provided on the tube connected to the control box, it may be unnecessary to disassemble the tube when a worker transfers the control box. As the deformable tube absorbs fluid impact of the refrigerant within the tube, it may prevent the tube or parts connected to the tube from being damaged.

Embodiments disclosed herein provide an outdoor unit or device for an air conditioner, which may be capable of absorbing a fluid impact of a refrigerant, preventing a control box from interfering with a tube when the control box is installed in the outdoor device, and repairing the tube of the outdoor device without removing the control box from the outdoor device. Embodiments disclosed herein also provide a tube connection structure capable of absorbing a fluid impact of the refrigerant and requiring disassemble of only a portion of a tube when the air conditioner is repaired.

Embodiments disclosed herein provide an outdoor unit or device for an air conditioner that may include a case including a front panel that defines a front surface and including a service panel, both side panels that define both sides, and a rear panel that defines a rear surface; an outdoor heat exchanger disposed or provided inside of the case, the outdoor heat exchanger having four heat exchange surfaces at positions corresponding to suction holes, which may be respectively defined in the front panel, both side panels, and the rear panel; a control box disposed or provided at a rear side of the service panel, the control box including an electronic case that accommodates an electronic component; and a moving unit or mover disposed or provided on one side of the case to guide movement of the control box. The control box may be movable in a direction in which a space part or space defined between the electronic case and the heat exchanger is increased in volume by the moving unit.

The moving unit may include a first bracket fixed to the case, and a second bracket fixed to the control box and selectively seated on or at a plurality of positions of or on the first bracket, the second bracket adjusting a position of the control box. The first bracket may be coupled to each of the side panels to extend in one direction.

The outdoor unit may further include a fan motor assembly including a shroud and a blower fan disposed or provided inside of the shroud, and a mounting member that supports the fan motor assembly. An end of the first bracket may be supported by the mounting member.

The outdoor heat exchanger may extend from one side of the control box and be bent along an inner surface of the case. The space part may define a space between an end of the outdoor heat exchanger and one surface of the control box.

The front panel may further include a suction panel, in which the suction hole may be defined. The space part may define a space between the suction hole of the suction panel and one surface of the electronic case.

A first opening may be defined in the first bracket, and a plurality of seat grooves may be defined below the first opening. The plurality of seat grooves may include a first seat groove, a second seat groove, and a third seat groove, which may be spaced apart from each other. The first seat groove may be defined in one side surface of the case, and the second seat groove may be defined between the first seat groove and the third seat groove.

The second bracket may include a fixed plate fixed to the control box, and a seated plate fixed to one side of the fixed plate. The seated plate may be selectively seated on the plurality of seat grooves. The seated plate may include a first plate fixed to the fixed plate, the first plate being seated on one seat groove of the plurality of seat grooves, and a second plate fixed to the first plate to prevent the first plate from being separated from the one seat grove.

The outdoor unit may further include a refrigerant tube fixed to the case; a cooling tube connected to the control box; and a deformable tube both ends of which are respectively fixed to the refrigerant tube and the cooling tube. The deformable tube may be deformable by an external force.

The deformable tube may include a tube which is deformable, and a pair of connectors fixed to each of both ends of the tube to connect the tube to each of the refrigerant tube and the cooling tube. The deformable tube may further include a protection member in which a plurality of wires may cross each other and protect the tube. The tube may include a corrugated tube.

The cooling tube may include a first cooling tube connected to the control box, and a second cooling tube disposed or provided adjacent to the first cooling tube. The second cooling tube may be connected to the control box.

The second plate may have a size greater than a size of one seat groove of the plurality of seat grooves.

An interference prevention groove that prevents a portion of the second plate from interfering with the first bracket when the second bracket is installed to the first bracket may be defined in one side of the first opening. A first screw hole may be defined in the first bracket, and a second screw hole may be defined in the second bracket. The first and second brackets may be fixed to each other by a fixing screw which may be coupled to each of the first and second screw holes. The fixing screw may be coupled to each of the first and second screw holes when the seated plate is seated on the second seat groove.

The refrigerant tube may include a supply tube connected to the first cooling tube to supply a liquid refrigerant, and a discharge tube connected to the second cooling tube to discharge a refrigerant, which may be heat-exchanged with the electronic unit. The electronic case may have a rectangular parallelepiped shape having a vertical height greater than a horizontal width, and the service panel may have a rectangular plate shape corresponding to a shape of the electronic case.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioner, the outdoor device comprising:

a case including a front panel that defines a front surface of the case and including a suction panel and a service panel positioned coplanar to one side of the suction panel, side panels that define both sides of the case, and a rear panel that defines a rear surface of the case;

an outdoor heat exchanger provided inside of the case, wherein the outdoor heat exchanger has four heat exchange surfaces at positions corresponding to a plurality of suction holes which is defined, respectively, in the suction panel, the side panels, and the rear panel, the outdoor heat exchanger being bent along inner surfaces of the suction panel, the side panels and the rear panel;

a control box provided at a rear side of the service panel, wherein the control box includes an electronic case that accommodates an electronic component;

a space defined in an internal space between the service panel and the suction panel and located between an end of the outdoor heat exchanger and one surface of the control box;

a mover provided at one side of the case to guide movement of the control box, wherein the control box is movable in a direction in which the space is increased in volume by the mover, a refrigerant tube fixed to the case;

a cooling tube connected to one surface of the control box; and at least one deformable tube provided in the space, wherein a first end of the at least one deformable tube is connected to the refrigerant tube and a second end of the at least one deformable tube is connected to the cooling tube;

wherein the mover includes:

a first bracket fixed to the case; and a second bracket fixed to the control box and adjusting a position of the control box, wherein a first opening is defined in the first bracket, wherein a plurality of seat grooves is defined at a bottom of the first opening, wherein the plurality of seat grooves is spaced apart from each other, wherein the second bracket is selectively seated at the plurality of seat grooves, and wherein the at least one deformable tube is deformed according to the movement of the mover.

2. The outdoor device according to claim 1, wherein the first bracket is coupled to one of the side panels to extend in one direction.

3. The outdoor device according to claim 2, further including:

at least one fan motor assembly including a shroud, and a blower fan provided inside of the shroud; and a mounting member that supports the at least one fan motor assembly, wherein an upper portion of the first bracket is supported by the mounting member.

4. The outdoor device according to claim 1, wherein the plurality of seat grooves includes a first seat groove, a second seat groove, and a third seat groove, wherein the first seat groove is defined at end of the first opening corresponding one side surface of the case, and wherein the second seat groove is defined between the first seat groove and the third seat groove.

5. The outdoor device according to claim 1, wherein the second bracket includes:

a fixed plate fixed to the control box; and a seated plate fixed to one side of the fixed plate, and wherein the seated plate is selectively seated on the plurality of seat grooves.

6. The outdoor device according to claim 5, wherein the seated plate includes:

a first plate fixed to the fixed plate, wherein the first plate is configured to be seated on one seat groove of the plurality of seat grooves; and a second plate fixed to the first plate to prevent the first plate from being separated from the one seat grove.

7. The outdoor device according to claim 1, wherein a first screw hole is defined in the first bracket, and a second screw hole is defined in the second bracket, and wherein the first and second brackets are fixed to each other by a fixing screw which is coupled to each of the first and second screw holes.

8. The outdoor device according to claim 7, wherein the fixing screw is coupled to each of the first and second screw holes when the seated plate is seated on the second seat groove.

9. The outdoor device according to claim 6, wherein the second plate has a size greater than a size of one seat groove of the plurality of seat grooves.

10. The outdoor device according to claim 6, further including an interference prevention groove defined in one side of the first opening, to prevent a portion of the second plate from interfering with the first bracket when the second bracket is installed to the first bracket.

11. The outdoor device according to claim 1, wherein the at least one deformable tube includes:

a pair of connectors fixed to each of both ends of the at least one deformable tube to connect the at least one deformable tube to each of the refrigerant tube and the cooling tube.

12. The outdoor device according to claim 11, wherein the at least one deformable tube further includes a protection member including a plurality of interwoven wires.

13. The outdoor device according to claim 11, wherein the at least one deformable tube includes a corrugated tube.

14. The outdoor device according to claim 1, wherein the cooling tube includes:

a first cooling tube connected to the control box; and a second cooling tube provided adjacent to the first cooling tube and connected to the control box.

15. The outdoor device according to claim 14, wherein the refrigerant tube includes:

a supply tube configured to supply a liquid refrigerant; and a discharge tube configured to discharge a refrigerant, which is heat-exchanged with the electronic component, wherein the at least one deformable tube includes:

a first deformable tube connecting the supply tube to the first cooling tube; and a second deformable tube connecting the discharge tube to the second cooling tube.

16. The outdoor device according to claim 1, wherein the electronic case has a rectangular parallelepiped shape having a vertical height greater than a horizontal width, and wherein the service panel has a rectangular plate shape corresponding to a shape of the electronic case.

17. The outdoor device according to claim 1, wherein the control box is movable between an installation position, a normal position, and a service position.

18. An air conditioner including the outdoor device of claim 1.

19. The outdoor device according to claim 1, wherein the control box is movable within the case, such that the space is increased or decreased in volume while the control box remains in the case.

* * * * *